US007603060B2

(12) United States Patent
Arakawa

(10) Patent No.: US 7,603,060 B2
(45) Date of Patent: Oct. 13, 2009

(54) IMAGE FORMING DEVICE AND POWER TRANSMISSION MECHANISM

(75) Inventor: Osamu Arakawa, Kyoto (JP)

(73) Assignee: Murata Machinery, Ltd., Kyoto (JP)

( * ) Notice: Subject to any disclaimer, the term of this patent is extended or adjusted under 35 U.S.C. 154(b) by 204 days.

(21) Appl. No.: 11/681,895

(22) Filed: Mar. 5, 2007

(65) Prior Publication Data

US 2007/0231007 A1 Oct. 4, 2007

(30) Foreign Application Priority Data

Mar. 30, 2006 (JP) ..... 2006-092765

(51) Int. Cl.
*G03G 15/00* (2006.01)

(52) U.S. Cl. ..... 399/167; 399/111

(58) Field of Classification Search ..... 399/167
See application file for complete search history.

(56) References Cited

U.S. PATENT DOCUMENTS

| | | | | |
|---|---|---|---|---|
| 5,708,933 | A * | 1/1998 | Nogami et al. | 399/167 |
| 5,905,927 | A * | 5/1999 | Inoue et al. | 399/167 |
| 6,101,354 | A | 8/2000 | Nakagawa et al. | |
| 6,885,838 | B2 * | 4/2005 | Kawai et al. | 399/167 |
| 2005/0276634 | A1 * | 12/2005 | Jeon | 399/167 |
| 2006/0051133 | A1 * | 3/2006 | Koishi et al. | 399/167 |

FOREIGN PATENT DOCUMENTS

| | | | |
|---|---|---|---|
| JP | 60-143360 | A | 7/1985 |
| JP | 04-242269 | A | 8/1992 |
| JP | 10-293467 | A | 11/1998 |
| JP | 11-109742 | A | 4/1999 |
| JP | 2000-267500 | A | 9/2000 |
| JP | 2000267500 | A * | 9/2000 |
| JP | 2002-278364 | A | 9/2002 |

OTHER PUBLICATIONS

Official communication issued in the counterpart European Application No. 07103397.1, mailed on Jul. 27, 2007.

* cited by examiner

*Primary Examiner*—David M Gray
*Assistant Examiner*—Roy Yi
(74) *Attorney, Agent, or Firm*—Keating & Bennett, LLP

(57) ABSTRACT

An image forming device includes a device main body, a drum unit, a stud which is fixed to a frame of the device main body, and a drum drive transmitting gear which is supported by the stud such that the drum drive transmitting gear can axially rotate. The drum unit includes a unit frame and a photoconductive drum which is supported on the unit frame such that the photoconductive drum can axially rotate. The photoconductive drum has a driven transmission gear at one end. When the drum unit is inserted into the device main body, the drum drive transmitting gear and the driven transmission gear are engaged with each other, and an end portion of the stud can be inserted into and received by an engaging hole of the unit frame of the drum unit.

15 Claims, 4 Drawing Sheets

IMAGE FORMING DEVICE AND POWER TRANSMISSION MECHANISM

BACKGROUND OF THE INVENTION

1. Field of the Invention

The present invention relates to an image forming device such as a facsimile machine, a copier, or a printer or the like (including a Multi Function Peripheral of the facsimile machine, the copier, and/or the printer). More specifically, the present invention relates to a power transmission mechanism of a drum unit in the image forming device. The drum unit, which defines an electrophotographic printing unit, can be removably inserted into a device main body from a front side of the device main body along a longitudinal direction thereof.

2. Description of the Related Art

An image forming device in which a drum unit can be inserted from a front side of a device main body along a longitudinal direction thereof is widely used in terms of handling convenience, etc. In such an image forming device, a mechanism for transmitting power to the drum unit is provided on a rear side of the device main body due to restrictions in the configuration of the device. Accordingly, a drive motor and a drive transmitting gear are attached to a frame on the rear side. In particular, a gear for transmitting power from the motor to a photoconductive drum of the drum unit is supported by a stud such that the gear can axially rotate. The stud is attached to the frame on the rear side of the device main body. When the drum unit is inserted into the device main body, a driven transmission gear, which is provided on the photoconductive drum, and the drive transmitting gear are engaged with each other. In such a case, an end portion of the stud is either unsupported (in a so-called cantilever state), or supported on a plastic or resin (hereinafter plastic) gear case, which is fixed to the frame.

Generally, when a process unit and a drum unit are provided in a device main body, and driving force is transmitted from the device main body to the process unit and the drum unit, a load torque is generated in each process mechanism unit (such as a photoconductive drum and a developing roller), which defines the process unit and the drum unit. Consequently, displacement may easily occur between the process unit and the drum unit. When such displacement occurs, the image quality is affected. Therefore, it has been conventionally suggested that an amount of displacement of the developing roller be preassumed so that the developing roller can be placed in the correct position when driven.

In the above-described image forming device, since the stud that supports the gear is either in a cantilever state or just supported on the plastic gear case at the end portion of the stud, an end of the stud may be swung by the load torque of the photoconductive drum when driven. Since such a swing occurs in a direction apart from a center axis of the photoconductive drum, a blur may occur in the image to be formed. In particular, in order to stabilize the drive transmission to the photoconductive drum, the drive transmission position is preferably set as close as possible to a center of the photoconductive drum in a longitudinal direction thereof. In such a case, however, the stud increases in length, the swing becomes larger, and consequently, the blur occurs more frequently.

SUMMARY OF THE INVENTION

In order to overcome the problems described above, preferred embodiments of the present invention provide, in an image forming device in which a drum unit can be inserted from a front side of a device main body, a driving force that is reliably transmitted to the drum unit.

In an image forming device according to a preferred embodiment of the present invention, a drum unit can be removably inserted from a front side of a device main body along a longitudinal direction thereof. A stud is attached to a frame on a rear side of the device main body, and is arranged parallel or substantially parallel to a center axis of the drum unit when the drum unit is inserted in the device main body. A drum drive transmitting gear is supported on the frame on the rear side via the stud such that the drum drive transmitting gear can axially rotate. The drum unit includes at least a unit frame and a photoconductive drum. The unit frame includes an engaging hole which can receive an end portion of the stud. The photoconductive drum is supported on the unit frame such that the photoconductive drum can axially rotate, and the photoconductive drum includes a driven transmission gear at one end. When the drum unit is inserted from the front side of the device main body into a prescribed position, a drum drive transmitting gear and the driven transmission gear are engaged with each other. At the same time, the end portion of the stud is inserted into and received by the engaging hole of the unit frame.

According to another preferred embodiment of the present invention, a positioning pin for positioning the drum unit in a prescribed position in the device main body is preferably attached to the frame on the rear side of the device main body such that the positioning pin is arranged parallel or substantially parallel to the stud. In such a case, it is preferable that the driven transmission gear be formed concentrically on a peripheral surface of a flange member fixed to one end of the photoconductive drum, and that a shaft hole, into which the positioning pin can be inserted, is formed at a center axis of the flange member.

According to another preferred embodiment of the present invention, since the drum unit can be removably inserted from a side (including a front side and a rear side) of the device main body, maintenance such as an exchange and cleaning of the drum unit is convenient. When the drum unit is inserted into the prescribed position in the device main body, the drum drive transmitting gear and the driven transmission gear are engaged with each other, and a rotational drive transmitting system of the photoconductive drum is established. At this time, the end portion of the stud for the drum drive transmitting gear is inserted into and received by the engaging hole provided in the unit frame. Therefore, the stud is supported at both ends, i.e., the stud is supported at an attaching portion on a stud base side on the frame on the rear side of the device main body and at a receiving portion in the engaging hole for the end portion. Accordingly, this supported state is highly stable, and an end of the stud is not swung by a load torque of the photoconductive drum when driven. Therefore, since a relative position between the stud and the center axis of the photoconductive drum does not change, the rotational drive transmitting system of the photoconductive drum, which is established when the drum drive transmitting gear and the driven transmission gear are engaged with each other, is reliably maintained. Thus, even when the stud increases in length, concern for generating a blur in an image is solved.

According to a preferred embodiment of the present invention, the drum unit can be accurately placed in the prescribed position in the device main body by the positioning pin. In addition, since the positioning pin is arranged parallel or substantially parallel to the stud, and the end portion of the stud is reliably supported by being inserted into and received by the engaging hole of the unit frame, the relative position between the stud and the photoconductive drum does not change. Accordingly, the rotational drive transmitting system of the photoconductive drum can be more reliably maintained. In this case, according to a still further preferred embodiment of the present invention, the driven transmission gear is formed concentrically on the peripheral surface of the flange member fixed to one end of the photoconductive drum, and the shaft hole, into which the positioning pin can be inserted, is formed at the center axis of the flange member. Therefore, the flange member, on which the driven transmission gear is formed, is directly positioned by the positioning pin of the drum unit. Thus, the drum drive transmitting gear and the driven transmission gear are accurately engaged with each other. Accompanying the reliably supported state of the stud, the rotational drive transmitting system of the photoconductive drum is more reliably maintained.

Other features, elements, processes, steps, characteristics and advantages of the present invention will become more apparent from the following detailed description of preferred embodiments of the present invention with reference to the attached drawings.

DETAILED DESCRIPTION OF PREFERRED EMBODIMENTS

Preferred embodiments of the present invention will be described with reference to the drawings.

Figure 1:
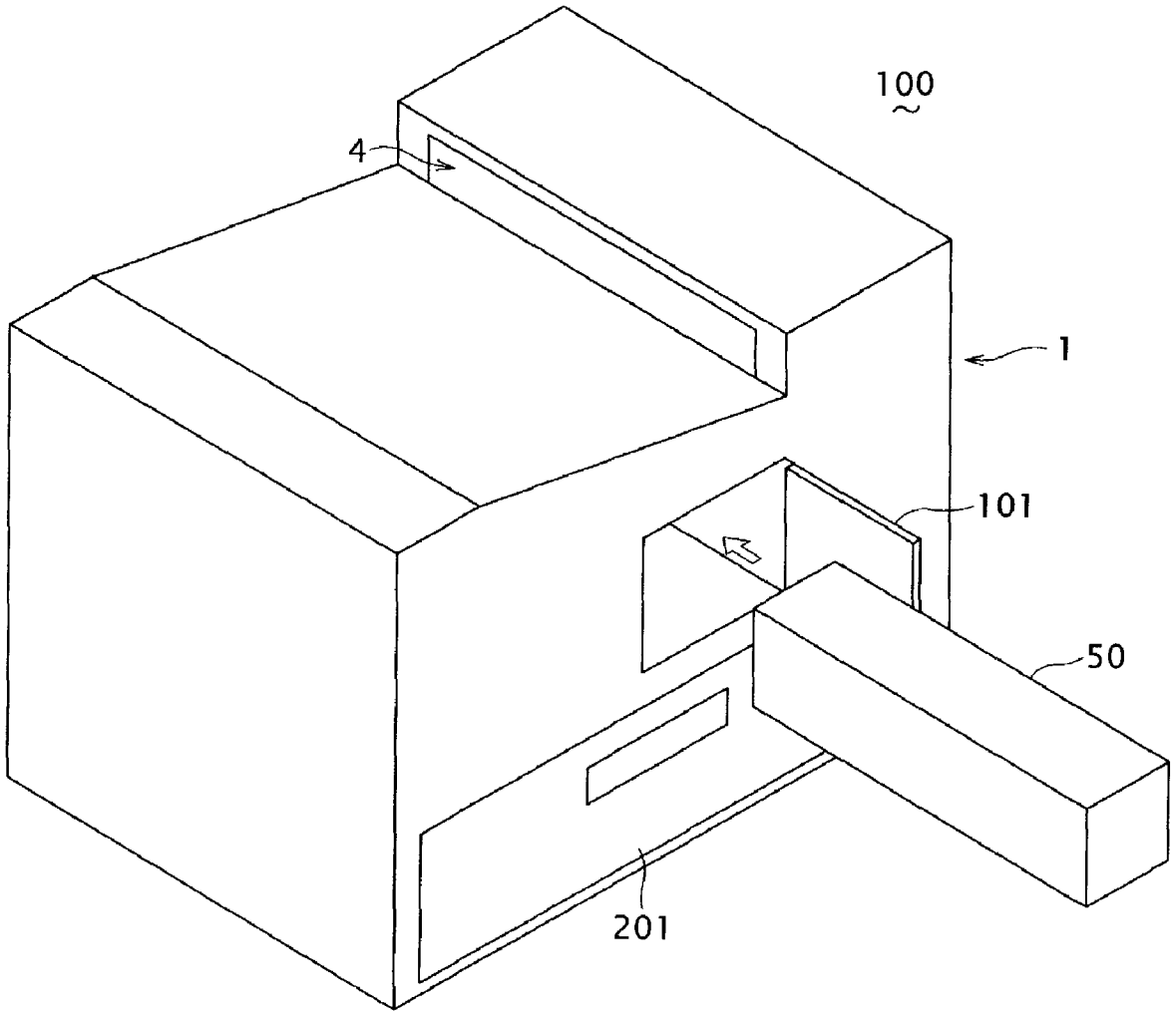
FIG. 1 is a schematic perspective view illustrating an example of an image forming device using a power transmitting mechanism according to a preferred embodiment of the present invention.
Figure 2:
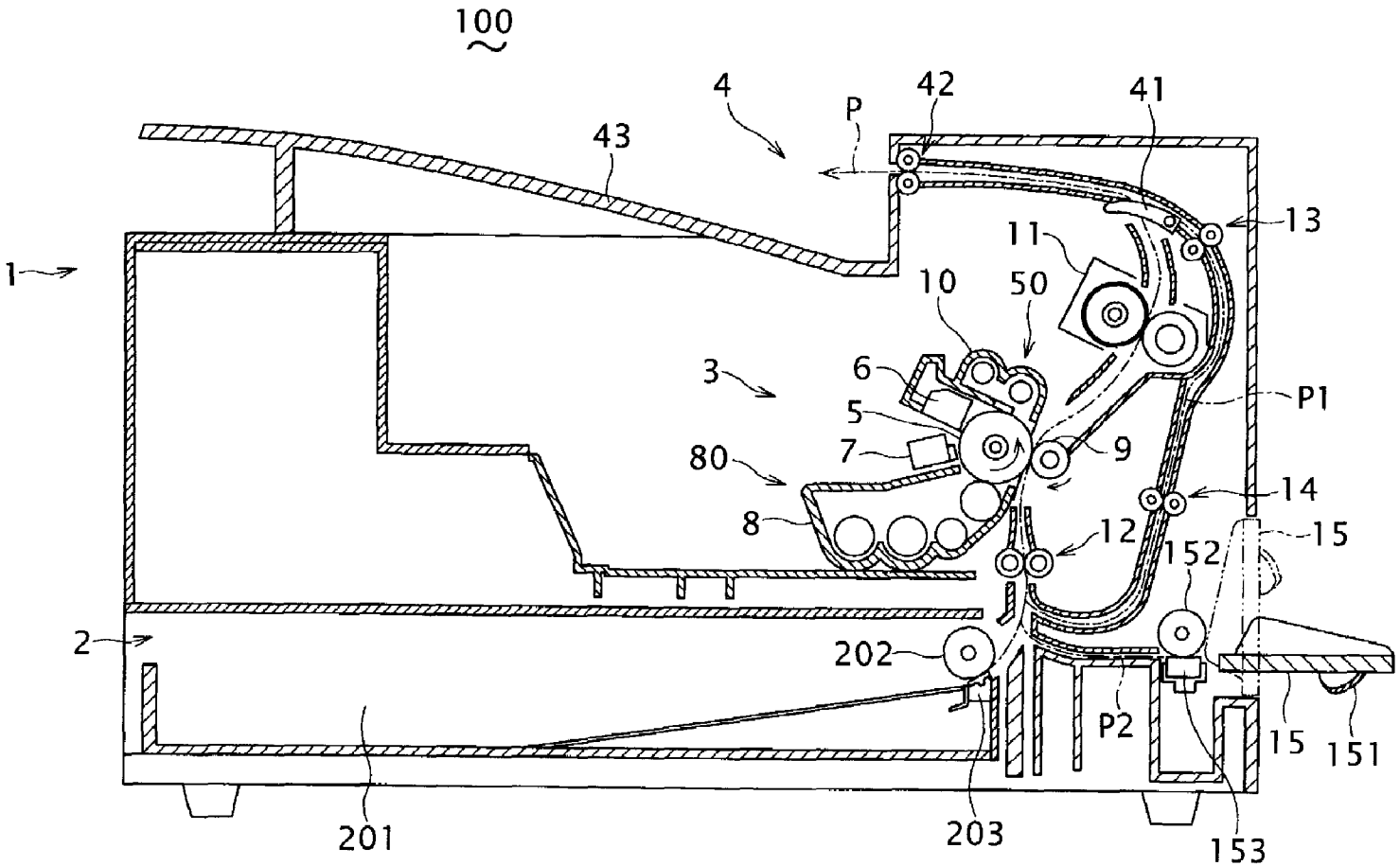
FIG. 2 is a longitudinal sectional view illustrating an example of an image forming device using a power transmitting mechanism according to a preferred embodiment of the present invention.

An image forming device 100 illustrated in FIGS. 1 and 2 is, for example, a printer including an electrophotographic printing unit. The present invention is not limited to such an example, and may be a copier, a facsimile machine, or a multi function peripheral (MFP) including a copier function and/or a facsimile function having an image scanning device. In the drawings, a device main body 1 of the image forming device 100 includes a paper feeding unit 2 containing printing paper, an electrophotographic image printing unit 3, and a discharge unit 4 for printed papers such that the above-described units are sequentially stacked in a height direction of the device main body 1. The paper feeding unit 2 includes a paper feed cassette 201, a paper separating and feeding roller 202, and a separating pad 203. The paper feed cassette 201 can accommodate a plurality of stacked printing papers, and can be inserted into and drawn out from the device main body 1. The paper separating and feeding roller 202 is arranged at a front end portion of the paper feed cassette 201. The separating pad 203 elastically makes contact with a peripheral surface of the paper separating and feeding roller 202.

The image printing unit 3 includes a process portion and a fuser 11, which is arranged downstream of the process portion. The process portion includes a photoconductive drum 5, a charger 6, an exposing unit 7, a developing unit 8, a transfer roller 9, and a remaining toner removing device 10. The charger 6, the exposing unit 7, the developing unit 8, the transfer roller 9, and the remaining toner removing device 10 are arranged in this order around the photoconductive drum 5. Excluding the exposing unit 7 and the transfer roller 9, the process portion is provided as a process unit including a drum unit 50 and a developing device unit 80. The photoconductive drum 5, the charger 6, and the remaining toner removing device 10 are contained together as the drum unit 50. A toner container, an agitator, and a developing roller or the like are contained together as the developing device unit 80. The drum unit 50 and the developing device unit 80 are removably inserted into the device main body 1 from a front side thereof. The drum unit 50 and the developing device unit 80 may be inserted separately, or inserted in a state in which the drum unit 50 and the developing device unit 80 are combined by some connecting structure. The entire process portion excluding the exposing unit 7 and the transfer roller 9 may be collectively provided as a process unit. The front side of the device main body 1 refers to a diagonally right front side in FIG. 1, and a diagonally left back side in FIG. 1 is referred to as a rear side. In the drawing, the drum unit 50 is illustrated in a state in which the drum unit 50 is being inserted into the device main body 1 from the front side thereof. A maintenance door 101 which can be opened and closed is provided on a front surface of the device main body 1. When the maintenance door 101 is opened, the drum unit 50 can be inserted and provided into a prescribed position in the device main body 1. The paper feed cassette 201 can be inserted into and drawn out from the front side of the device main body 1. An insertion process of the drum unit 50 will be described below.

A switching gate 41, a discharge roller pair 42, and a discharge tray 43 are arranged downstream of the fuser 11. The switching gate 41, the discharge roller pair 42, and the discharge tray 43 define the discharge unit 4. A resist roller pair 12 is arranged near an upstream side of the process portion. Printing papers are separated and fed one by one from the paper cassette 201 by the paper separating and feeding roller 202 and the separating pad 203, and resisted by the resist roller pair 12. The printing paper is then introduced into a nip portion between the photoconductive drum 5 and the transfer roller 9. The photoconductive drum 5 rotates in a direction of an arrow illustrated in FIG. 2, and a surface of the photoconductive drum 5 is uniformly charged by the charger 6. An optical image based on image information is irradiated on the surface of the photoconductive drum 5 by the exposing unit 7. Accordingly, an electrostatic latent image is formed on the surface of the photoconductive drum 5. According to characteristics of a photoconductor on the surface of the photoconductive drum 5, an electric potential of an irradiated portion changes while an electric potential of other portions is maintained, and the electrostatic latent image is formed.

The electrostatic latent image is sequentially developed as a toner image by the biased developing unit 8. The toner image then reaches the nip portion between the photoconductive drum 5 and the transfer roller 9. During this developing process, on a portion where the electric potential has been changed by light irradiation, due to a potential difference between the developing unit 8 and the electrostatic latent image, toner is adhered to the photoconductive drum 5 to form a black portion, and toner is not adhered to a remaining portion of the photoconductive drum 5 where a white portion is formed. Therefore, a black and white image according to image information is formed as a whole. The resist roller pair 12 is resist controlled, and then rotatably driven such that a printing paper is introduced into the nip portion in synchronism with the toner image on the surface of the photoconductive drum 5.

A bias voltage is provided on the transfer roller 9. The transfer roller 9 makes contact with the photoconductive drum 5, and nips and transports the printing paper while being rotatably driven in a direction illustrated by an arrow in FIG. 2. At this time, the toner image on the surface of the photoconductive drum 5 is transferred onto the printing paper. The toner remaining on the surface of the photoconductive drum 5 is removed and collected by the remaining toner removing device 10. The printing paper on which the toner image has been transferred is introduced into the fuser 11 and fixed as a permanent image. The printing paper then pushes up the switching gate 41, and is discharged onto the discharge tray 43 through the discharge roller pair 42. This series of the paper feeding and transporting process is carried out along a main feeding path P. The main feeding path P rises substantially vertically (substantially perpendicularly) immediately above the paper feed cassette 201, and at a portion where the switching gate 41 is provided, makes a U-turn in a direction substantially 180 degrees opposite from a direction in which the main feeding path P extends from the paper feed cassette 201. Such a layout structure minimizes the size of the image forming device as a whole.

The image forming device 100 illustrated in the drawings includes a duplex printing function. A reverse transportation path P1 joins the main feeding path P such that the reverse transportation path P1 passes from a position where the switching gate 41 is provided to an upstream side of the resist roller pair 12 in the main feeding path P. The discharge roller pair 42 can rotate in both directions. Transportation roller pairs 13 and 14 are provided in the reverse transportation path P1. When performing duplex printing, after one side of the printing paper is printed, the printing paper is transported along the main feeding path P, and a trailing edge of the printing paper reaches the discharge roller pair 42. The discharge roller pair 42 then stops once and maintains a state in which the discharge roller pair 42 nips the trailing edge of the printing paper. Next, the discharge roller pair 42 rotates reversely, and the printing paper, with the trailing edge thereof ahead, is transported through the reverse feeding path P1 by the transportation roller pairs 13 and 14. The printing paper joins the main feeding path P and reaches the resist roller pair 12. The printing paper is resisted by the resist roller pair 12, and is again introduced into the nip portion between the photoconductive drum 5 and the transfer roller 9. At this time, a reverse side of the printing paper is printed. After both sides of the printing paper are printed, the printing paper is transported along the main feeding path P and discharged onto the discharge tray 43 as described above.

The image forming device 100 illustrated in the drawings further includes a manual paper feeding function. A manual paper feeding tray 15, which can be opened and closed vertically, is provided on a side portion of the device main body 1. When not using the manual paper feeding tray 15, the manual paper feeding tray 15 is closed as illustrated by double-dashed lines in FIG. 2. When using the manual paper feeding tray 15, the manual paper feeding tray 15 can be opened and closed by operating a gripper 151. A paper separating and feeding roller 152 and a separating pad 153 are arranged to elastically contact with each other at a front end portion of the manual paper feeding tray 15. A manual paper feeding path P2, which joins the main feeding path P, is arranged further downstream of such a contact portion.

When performing an image printing using the manual paper feeding tray 15, the gripper 151 is operated to open the manual paper feeding tray 15. Printing papers are set on the opened manual paper feeding tray 15, and after a start operation is performed, the manual paper feeding roller 152 is rotated. The printing papers on the manual paper feeding tray 15 are separated and fed one sheet at a time by the paper separating and feeding roller 152 and the separating pad 153. The printing paper is transported through the manual paper feeding path P2, and joins the main feeding path P. Then, the printing paper is resisted by the resist roller pair 12, and is introduced into the nip portion between the photoconductive drum 5 and the transfer roller 9. At this time, an image printing is performed. When performing duplex printing on a manually fed paper, the printing paper is transported by the reversely rotating discharge roller pair 42 through the reverse feeding path P1, and the printing is performed on the reverse side of the printing paper as described above. After the printing is completed, the printing paper is discharged by the discharge roller pair 42 onto the discharge tray 43.

Figure 3:
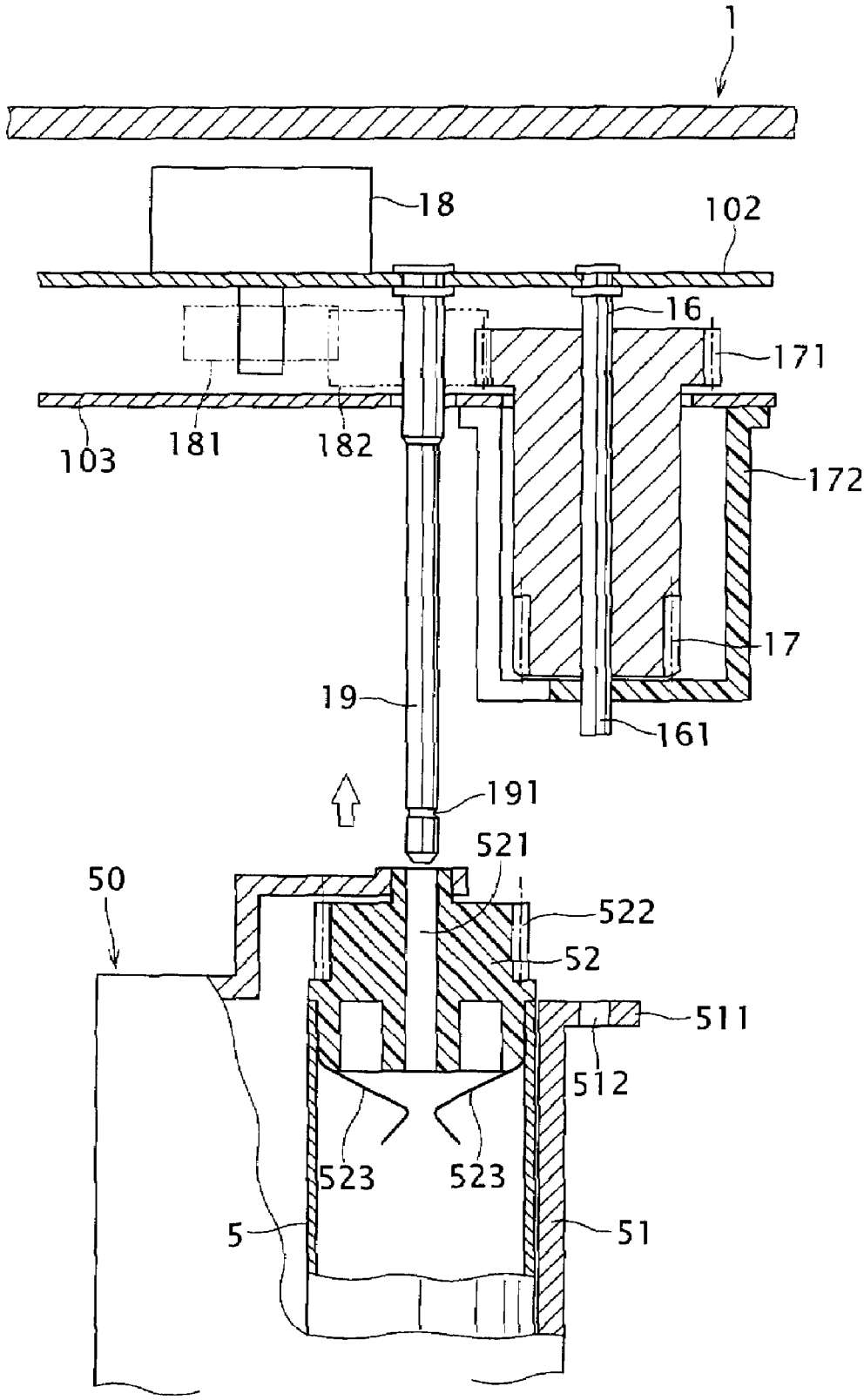
FIG. 3 is a plan sectional view illustrating a power transmitting mechanism of a drum unit in a state in which a power transmitting system is yet to be established according to a preferred embodiment of the present invention.
Figure 4:
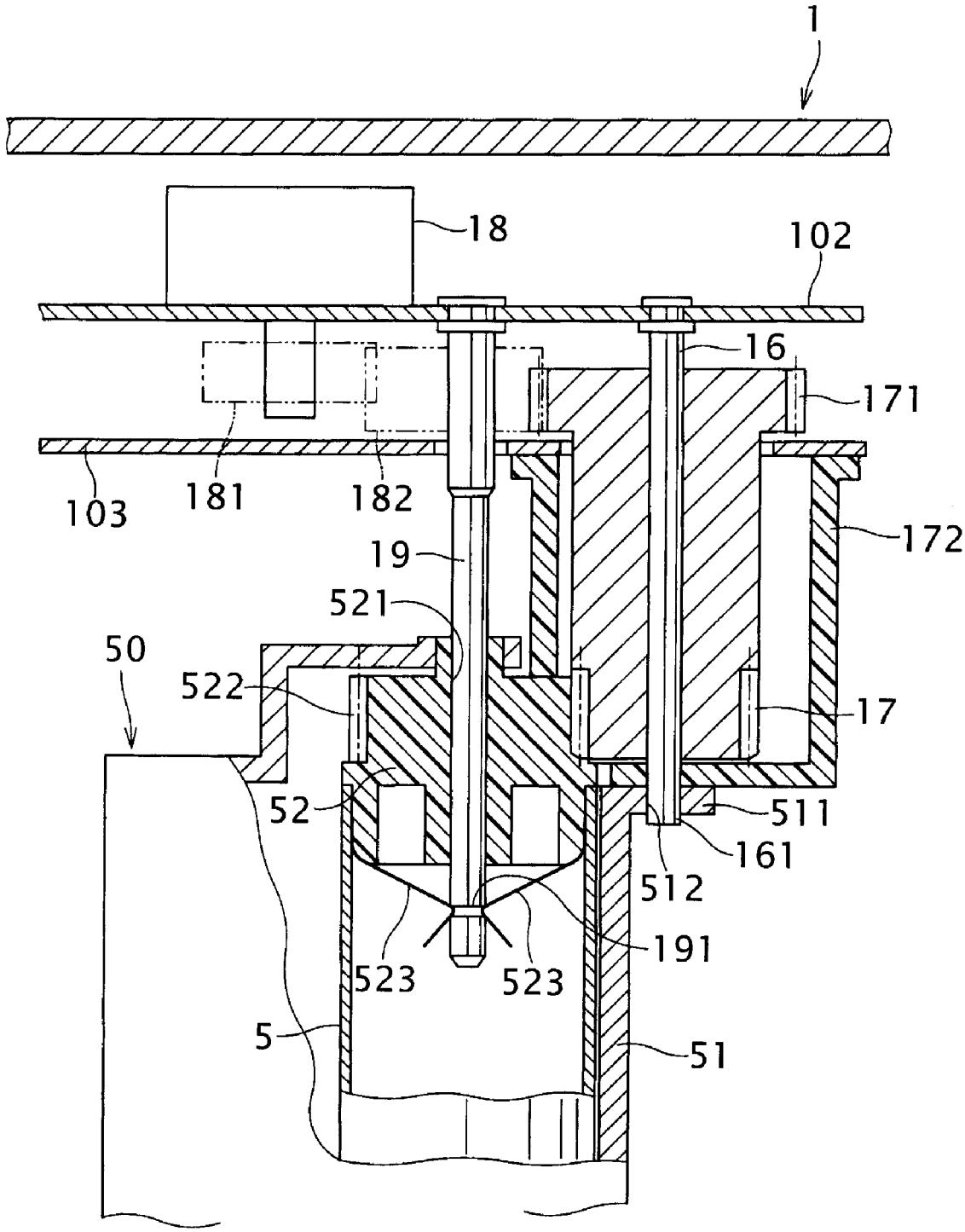
FIG. 4 is a plan sectional view illustrating a power transmitting mechanism of a drum unit in a state in which the power transmitting system has been established according to a preferred embodiment of the present invention.

Next, a detailed description will be made of a power transmission mechanism for the drum unit 50 with reference to FIGS. 3 and 4. Driving portion attaching boards 102 and 103 are provided as a portion of a rear side frame on the rear side of the device main body 1. A stud 16 is fixed to the driving portion attaching board 102 by being attached and screwed such that the stud 16 is arranged parallel or substantially parallel to a center axis of the drum unit 50. A drum drive transmitting gear 17 is supported by the stud 16 such that the drum drive transmitting gear 17 can axially rotate. The drum drive transmitting gear 17 is preferably a double gear. A drive transmitting system from a motor 18 to the drum drive transmitting gear 17 is provided to an input gear 171 on a base side. The drive transmitting system is engaged with an idler gear 182. The idler gear 182 is connected to an output gear 181 of the motor 18. The motor 18 is fixedly attached to the driving portion attaching board 102. The idler gear 182 is supported by a stud (not illustrated) bridged between the driving portion attaching boards 102 and 103 such that the idler gear 182 can axially rotate. The idler gear is not limited to only one, and a plurality of idler gears may be provided according to the design. Moreover, a drive transmitting system (not illustrated) for driving other process portions is similarly provided between the driving portion attaching boards 102 and 103. The drum drive transmitting gear 17 is covered by a plastic gear case 172 except for a portion where the drum drive transmitting gear 17 is engaged with a driven transmission gear 522. The plastic gear case 172 is attached to the driving portion attaching board 103. An end portion 161 of the stud 16 protrudes from the plastic gear case 172.

A conductive positioning pin 19 is attached and screwed to the driving portion attaching board 102. The conductive positioning pin 19 penetrates through the driving portion attaching board 103, and is arranged parallel or substantially parallel to the stud 16. The photoconductive drum 5 is supported in the unit frame 51 such that the photoconductive drum 5 can axially rotate. An overhanging portion 511 extends from a side portion of the unit frame 51. An engaging hole 512, which has substantially the same diameter as the end portion 161, is provided in the overhanging portion 511.

The photoconductive drum 5 includes a conductive cylindrical body, which is preferably made of aluminum or other suitable material. A surface of the conductive cylindrical body is coated with a photoconductor. A flange member 52 (only one side thereof is illustrated in the drawings), which is preferably made of insulating plastic or other suitable material, is fixed to an opening portion at both ends of the conductive cylindrical body. The photoconductive drum 5 is supported on the unit frame 51 by the flange member 52 at both ends such that the photoconductive drum 5 can axially rotate. A shaft hole 521, into which the positioning pin 19 can be inserted, is provided at a center axis of the flange member 52. Further, the driven transmission gear 522 is concentrically formed on a peripheral surface of the flange member 52, which is arranged on the rear side of the device main body 1. A contacting terminal 523 is arranged at a fixed portion, where the flange member 52 and an inner surface of the photoconductive drum 5 are fixed to each other. Free edges of contacting terminals 523 are bent, and elastically make contact with a peripheral surface of the positioning pin 19 when the drum unit 50 is inserted into the prescribed position in the device main body 1. Thus, the inner surface of the photoconductive drum 5 and the positioning pin 19 are conductively connected.

In the above-described configuration, the drum unit 50 is inserted into the device main body 1 along a direction illustrated by an arrow in FIG. 1. Further, the drum unit 50 is inserted in a direction illustrated by an outlined arrow in FIG. 3 into the prescribed position in the device main body 1, and such a state is maintained. At this time, the positioning pin 19 is inserted into the shaft hole 521 of the flange member 52. The driven transmission gear 522 is engaged with the drum drive transmitting gear 17. In addition, the end portion 161 of the stud 16 is inserted into and received by the engaging hole 512 of the unit frame 51. Further, the bent portions at the ends of the pair of contacting terminals 523 are positioned in a constricted portion 191 with a reduced diameter formed at an end of the positioning pin 19, and elastically and slidably make contact with the constricted portion 191.

The drum unit 50 is guided along a guide member (not illustrated), which is provided in the device main body 1, and is inserted into the device main body 1. When the maintenance door 101 is closed, the drum unit 50 is positioned by the positioning pin 19 and is held in the prescribed position in the device main body 1. Further, when the driven transmission gear 522 and the drum drive transmitting gear 17 are engaged with each other, a transmission pathway of a rotational driving force from the motor 18 to the photoconductive drum 5 is established. Accordingly, the photoconductive drum 5 is axially rotated around the center axis of the positioning pin 19 by the rotational driving force from the motor 18.

Further, the end portion 161 of the stud 16 is inserted into and received by the engaging hole 512 of the unit frame 51. Therefore, the stud 16 is supported at both ends by the driving portion attaching board 102 and the unit frame 51. Accordingly, the end of the stud 16 does not swing even when receiving a load torque accompanying the rotation of the photoconductive drum 5. Thus, the stud 16 and the positioning pin 19 are maintained to be parallel or substantially parallel to each other. In addition, since the driven transmission gear 522 and the drum drive transmitting gear 17 are engaged with each other, the rotational drive transmitting system of the photoconductive drum 5 is established and reliably maintained. Accordingly, concern for generating blurs or the like in an image to be formed is reduced. In addition, the driven transmission gear 522 and the drum drive transmitting gear 17 are preferably provided as diagonally-toothed gears. Therefore, the engaged state is secured, and the driving force can be smoothly transmitted.

The positioning pin 19 is grounded via the driving portion attaching board 102. In an image forming process, when the surface of the photoconductive drum 5 is exposed, light is irradiated on the surface of the uniformly charged photoconductive drum 5. Electrical conductivity is generated on the photoconductor of the irradiated portion. Accordingly, a charge on the irradiated portion flows to the ground via a light conductive cylindrical body in the photoconductive drum 5, the contacting terminal 523, the positioning pin 19, and the driving portion attaching board 102. Thus, an electrostatic latent image is formed on the surface of the photoconductive drum 5 according to the charged portions and the uncharged portions.

In the above-described preferred embodiments, an example is described of the image forming device 100 which is a printer of a single cassette type. However, the present invention does not exclude a printer of a multi cassette type. Moreover, optional paper cassettes or the like may be further stacked under the paper feed cassette 201 illustrated in FIG. 1.

While the present invention has been described with respect to preferred embodiments thereof, it will be apparent to those skilled in the art that the disclosed invention may be modified in numerous ways and may assume many embodiments other than those specifically set out and described above. Accordingly, the appended claims are intended to cover all modifications of the present invention that fall within the true spirit and scope of the present invention.

What is claimed is:

1. An image forming device comprising:

a device main body including a frame;

a drum unit which can be removably inserted into the device main body along a longitudinal direction of the device main body, the drum unit including:

a unit frame having an engaging hole which can receive an portion on a stud; and a photoconductive drum which is supported on the unit frame such that the photoconductive drum can axially rotate, and has a driven transmission gear at one end;

a stud fixed to the frame of the device main body such that the stud is arranged parallel or substantially parallel to a center axis of the drum unit when the drum unit is inserted in the device main body; and a drum drive transmitting gear which supported by the stud which that the drum drive transmitting gear can axially rotate; and a contacting terminal arranged adjacent to photoconductive drum; wherein a pin is fixed to the frame of the device main body such that the pin is arranged parallel or substantially parallel to the stud;

a free edge of the contacting terminal is bent, and when the drum unit is inserted into the device main body, the contacting terminal elastically makes contact with a reduced diameter constricted portion at an end of the pin such that the inner surface of the photoconductive drum and the pin are conductively connected; and when the drum unit is not inserted into the device main body, the contacting terminal does not contact the pin; and when the drum unit is inserted into the device main body, the drum drive transmitting gear and the driven transmission gear are engaged with each other, and the end portion of the stud is inserted into and received by the engaging hole of the unit frame.

2. The image forming device according to claim 1, wherein a front side of the device main body includes a door, and the drum unit can be inserted into and drawn out from the front side of the device main body through the door.

3. The image forming device according to claim 1, wherein the pin is arranged to position the drum unit in a prescribed position in the device main body.

4. The image forming device according to claim 3, wherein the driven transmission gear is provided on a peripheral surface of a flange member which is fixed to one end of the photoconductive drum; and a shaft hole, into which the pin can be inserted, is formed at a center axis of the flange member.

5. The image forming device according to claim 2, wherein the drum drive transmitting gear is a double gear.

6. The image forming device according to claim 5, wherein a base portion of the drum drive transmitting gear is an input gear, and the input gear is connected to an output gear of a motor.

7. The image forming device according to claim 2, wherein the drum drive transmitting gear is covered by a gear case except for a portion where the drum drive transmitting gear is engaged with the driven transmission gear.

8. The image forming device according to claim 4, wherein the contacting terminal is provided at a portion where the flange member and an inner surface of the photoconductive drum are fixed to each other.

9. A device main body of an image forming device into which a drum unit is inserted, the device main body comprising:

a frame;

a stud fixed to the frame such that the stud is arranged parallel or substantially parallel to a center axis of the drum unit when the drum unit is inserted in the device main body; and a drum drive transmitting gear which is supported by the stud such that the drum drive transmitting gear can axially rotate; wherein the drum unit can be removably inserted into the device main body along a longitudinal direction of the device main body, and the drum unit includes:

a unit frame having an engaging hole which can receive an end portion of the stud; and a photoconductive drum which is supported on the unit frame such that the photoconductive drum can axially rotate, and has a driven transmission gear at on end; and a contacting terminal arranged adjacent to the photoconductive drum;

wherein or substantially parallel to the stud;

a free edge of the contacting terminal is bent, and when the drum is inserted into the device main body, the contacting terminal elastically makes contact with a reduced diameter constricted portion at an end of the pin such that the inner surface of the photoconductive drum and the pin are conductively connected; and when the drum unit is not inserted into the device main body, the contacting terminal does not contact the pin; and when the drum unit is inserted into the device main body, the drum drive transmitting gear is engaged with the driven transmission gear, and the end portion of the stud is inserted into the engaging hole of the unit frame.

10. The device main body according to claim 9, wherein the pin is arranged to position the drum unit into a prescribed position in the device main body.

11. The device main body according to claim 10, wherein the drum drive transmitting gear is a double gear.

12. The device main body according to claim 11, wherein a base portion of the drum drive transmitting gear is an input gear, and the input gear is connected to an output gear of a motor.

13. The device main body according to claim 12, wherein the drum drive transmitting gear is covered by a gear case except for a portion where the drum drive transmitting gear is engaged with the driven transmission gear.

14. A drum unit comprising:

a unit frame including an engaging hole arranged to receive an end portion of a stud; and a photoconductive drum which is supported on the unit frame such that the photoconductive drum can axially rotate, and has a driven transmission gear at one end;

a contacting terminal arranged adjacent to the photoconductive drum; wherein a pin is fixed to the unit frame such that the pin is arranged parallel or substantially parallel to the stud;

a free edge of the contacting terminal is bent, and the contacting terminal elastically makes contact with a reduced diameter constricted portion at an end of the pin such that the inner surface of the photoconductive drum and the pin are conductively connected.

15. The drum unit according to claim 14, wherein the driven transmission gear is provided on a peripheral surface of a flange member which is fixed to one end of the photoconductive drum; and a shaft hole, into which the pin can be inserted, is formed at a center axis of the flange member.

* * * * *